US005683225A

United States Patent [19]

Orlando et al.

[11] Patent Number: 5,683,225

[45] Date of Patent: Nov. 4, 1997

[54] JET ENGINE VARIABLE AREA TURBINE NOZZLE

[75] Inventors: Robert Joseph Orlando, West Chester; Lawrence Wayne Dunbar, Loveland, both of Ohio

[73] Assignee: General Electric Company, Cincinnati, Ohio

[21] Appl. No.: 783,668

[22] Filed: Oct. 28, 1991

[51] Int. Cl.[6] ..... F01D 17/12; F03B 3/14

[52] U.S. Cl. ..... 415/155; 415/159

[58] Field of Search ..... 415/155, 159

[56] References Cited

U.S. PATENT DOCUMENTS

| | | | |
|---|---|---|---|
| 3,224,194 | 12/1965 | De Feo et al. | 60/35.6 |
| 3,314,654 | 4/1967 | Thenault et al. | 253/78 |
| 4,169,692 | 10/1979 | McDonough et al. | 415/115 |
| 4,193,738 | 3/1980 | Landis, Jr. et al. | 415/115 |
| 4,221,114 | 9/1980 | Wilde et al. | 60/242 |
| 4,254,619 | 3/1981 | Giffin, III et al. | 60/226 R |
| 4,446,696 | 5/1984 | Sargisson et al. | 60/226.3 |
| 4,579,507 | 4/1986 | Corrigan et al. | 415/159 |
| 4,582,466 | 4/1986 | Szczupak | 415/150 |
| 4,657,481 | 4/1987 | Mowill et al. | 415/155 |
| 4,798,515 | 1/1989 | Hsia et al. | 415/115 |
| 4,984,965 | 1/1991 | Mc Kean | 415/155 |
| 5,035,573 | 7/1991 | Tseng et al. | 415/173.2 |

FOREIGN PATENT DOCUMENTS

| | | | |
|---|---|---|---|
| 627568 | 1/1963 | Belgium | 415/159 |
| 951944 | 11/1949 | France | 415/159 |

OTHER PUBLICATIONS

"Partially Variable Area Turbine Nozzle", b R.H. Andersen and R.C. Haubert, GE, Cincinnati, OH, presented at AIAA/SAE/ASME 15th Joint Propulsion Conference, Jun. 18–20, 1979, Las Vegas, Nevada.

*Primary Examiner*—Michael J. Carone
*Assistant Examiner*—Theresa M. Wesson
*Attorney, Agent, or Firm*—Andrew C. Hess; Patrick R. Scanlon

[57] ABSTRACT

A turbine nozzle for a gas turbine engine subassembly having an axial turbine. The turbine nozzle airfoil-shaped vanes are fixedly attached to one or both of the annular inner and outer casings. Apparatus is provided to vary the vane airflow passage area between the casings and between the pressure side of one vane and the suction side of an adjacent vane. The apparatus varies the area near at least the pressure side of the one vane. Various embodiments of the apparatus include: a small pivotable flap pivotally attached to the outer casing and positioned near the pressure side of the one vane; a small movable flap attached to the outer casing to be movable along the pressure side of the one vane, and a plug member insertable into and withdrawable from the vane airflow passage through the outer casing near at least the pressure side of the one vane.

6 Claims, 4 Drawing Sheets

JET ENGINE VARIABLE AREA TURBINE NOZZLE

BACKGROUND OF THE INVENTION

The present invention relates generally to jet engines having axial turbines, and more particularly to variable area turbine nozzles for such turbines.

The phrase "jet engines" includes gas turbine engines (such as turbojet engines, bypass turbofan engines, turboprop engines, turboshaft engines, etc.) and those ramjet and scramjet engines which employ gas turbine engines for low speed operation. Such jet engines may be used to power flight vehicles (such as planes, helicopters, and missiles, etc.) and the gas turbine engine type of jet engine may also be used to power ships, tanks, electric power generators, pipeline pumping apparatus, etc. For purposes of illustration, the invention will be described with respect to a high pressure axial turbine. However, it is understood that the invention is equally applicable to other types of axial turbines such as, but not limited to, low pressure and intermediate pressure axial turbines. Low pressure turbines, which typically turn the fans of bypass turbofan engines, are sometimes called power turbines.

An axial gas turbine engine includes a core engine having, in serial flow relationship, a high pressure axial compressor to compress the air flow entering the core engine, a combustor in which a mixture of fuel and the compressed air is burned to generate a propulsive gas flow, and a high pressure axial turbine which is rotated by the propulsive gas flow and which is connected by a shaft to drive the high pressure compressor. An axial turbine is designed to have the propulsive gas flow move generally longitudinally (axially) through the turbine. The high pressure turbine includes a longitudinally forward-most row of circumferentially spaced-apart turbine rotor blades. A turbine nozzle is positioned longitudinally between the combustor and the forward-most row of turbine rotor blades. The turbine nozzle includes a row of circumferentially spaced-apart turbine nozzle vanes which turn the flow for more efficient presentation to the rotor blades.

It is known to vary the area of the turbine nozzle for different operating conditions of the engine. Known techniques to vary the area of the turbine nozzle of an axial turbine include rotating the airfoil-shaped vanes to different angular settings for different operating conditions of the engine. Known designs include rotating the entire vane, rotating just the aft portion of the vane, rotating all the vanes, and rotating just some of the vanes. These techniques have required sizable rotational attachment apparatus and actuation mechanisms for rotating the vanes (or just their aft ends), and such apparatus have suffered from significant propulsive gas flow leakage which bas decreased engine efficiency and hence increased specific fuel consumption. What is needed is an improved technique to vary the area of the turbine nozzle in an axial turbine of a jet engine.

SUMMARY OF THE INVENTION

It is an object of the invention to provide a variable area turbine nozzle for an axial turbine of a jet engine which minimizes leakage of propulsive gas flow.

It is another object of the invention to vary the area of such a turbine nozzle without incurring any significant size or weight penalty.

The invention provides a turbine nozzle in a gas turbine engine subassembly having an axial turbine including a longitudinally forward-most row of turbine rotor blades. The turbine nozzle includes a generally annular inner casing extending generally longitudinally forward and aft, and a generally annular outer casing spaced apart from and generally coaxially surrounding the inner casing. The turbine nozzle further includes first and second circumferentially adjacent turbine nozzle vanes. Each vane is fixedly attached to either or both of the casings. The vanes can be positioned longitudinally adjacent and forward of the blades. Each vane has a generally airfoil shape with a leading edge, a suction side, a trailing edge, and a pressure side. The pressure side of the first vane is circumferentially spaced apart from the suction side of the second vane to define a vane airflow passage which is bounded by the two vanes and the two casings. The turbine nozzle additionally includes apparatus for varying the area of the vane airflow passage near at least the pressure side of the first vane.

In a first preferred embodiment, such area-varying apparatus includes a plug member having a portion insertable into and withdrawable from the vane airflow passage through one of the casings near at least the pressure side of the first vane. Such area-varying apparatus further includes a mechanism for inserting the portion into and withdrawing the portion from the vane airflow passage.

In a second preferred embodiment, the turbine nozzle includes a row of circumferentially spaced apart such vanes. The area-varying apparatus includes a pivotable flap having a first end which is pivotally attached to one or both of the casings and which is positioned near the pressure side of one of the vanes. Such area-varying apparatus further includes a mechanism for pivoting the flap away from and towards the pressure side of the one vane.

In a third preferred embodiment, the turbine nozzle also includes the above-mentioned row of vanes. The area-varying apparatus includes a movable flap having a first side which is positioned near the pressure side of one of the vanes. The movable flap is attached to one or both of the casings with the first side movable proximately along the pressure side of the one vane near the trailing edge of the one vane. Such area-varying apparatus further includes a mechanism for moving the flap proximately along the pressure side of the one vane near the trailing edge of the one vane.

Several benefits and advantages are derived from the turbine nozzle of the invention. The area of the turbine nozzle is varied by moving a small plug member or by rotating or moving a small flap which is separate from the larger fixed vane. The actuation mechanism for the small plug member or flap can be made smaller and lighter than actuation mechanisms required to rotate the entire vane (or its aft portion) in known variable area turbine nozzle designs. A smaller actuation mechanism means less leakage of propulsive gas flow which will improve engine efficiency and specific fuel consumption. By varying the turbine nozzle area at least at the pressure side of the vane, the flow is at least blocked in a generally low Mach number region on the airfoil which means smaller performance losses for a given reduction in turbine nozzle area.

BRIEF DESCRIPTION OF THE DRAWINGS

The accompanying drawings illustrate several preferred embodiments of the present invention wherein.

DETAILED DESCRIPTION OF THE INVENTION

Figure 1A:
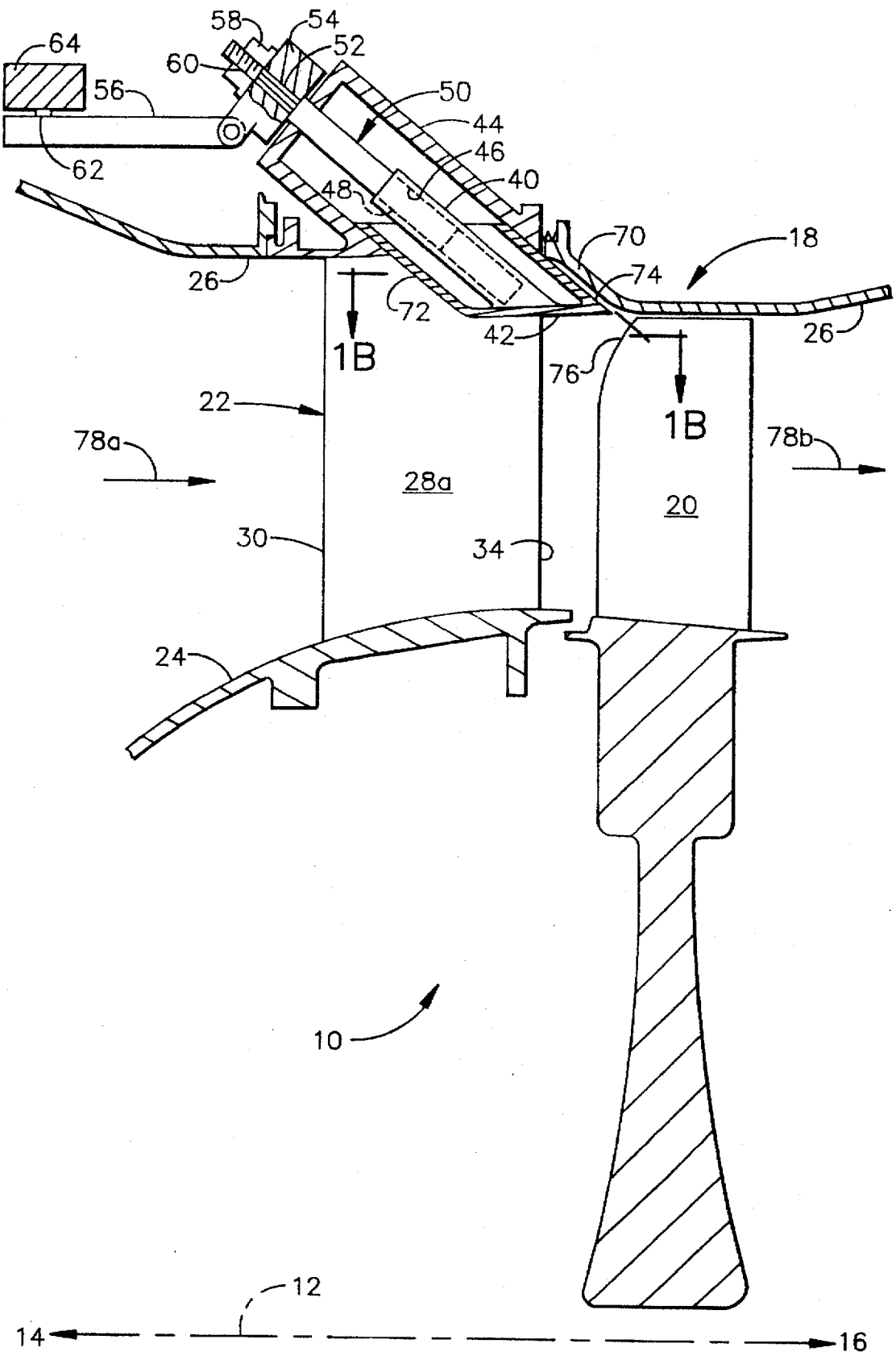
FIG. 1A is a schematic cross-sectional side view of a gas turbine engine subassembly including a turbine nozzle whose area is varied by a plug member having a portion which can be inserted into and withdrawn from the vane airflow passage.
Figure 1B:
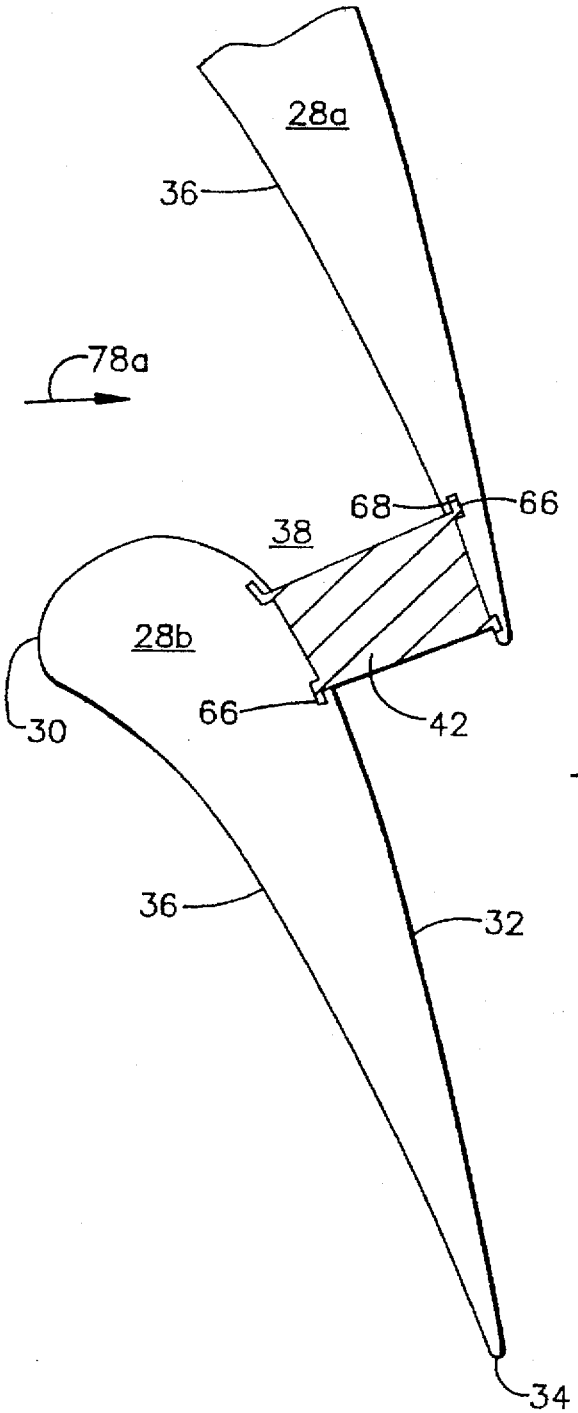
FIG. 1B is a schematic cross-sectional top view of a portion of FIG. 1A taken along lines 1B—1B.

Referring now to the drawings, and particularly to FIGS. 1A and 1B, there is illustrated generally a gas turbine engine subassembly 10 having an axis 12 extending generally longitudinally forward 14 and aft 16. The subassembly 10 has an axial turbine 18 which includes a longitudinally forward-most row of turbine rotor blades 20, only one of which is shown in FIG. 1A. The axial turbine 18 is shown in FIG. 1A as a single-stage high pressure turbine. However, the invention is equally applicable to other axial turbines such as, but not limited to, single or multi-stage intermediate or low pressure turbines.

The subassembly 10 has a turbine nozzle 22 which, by way of description, may be considered separate from, or a part of, the axial turbine 18. The turbine nozzle 22 includes a generally annular inner casing 24 extending generally longitudinally forward and aft and a generally annular outer casing 26 which is spaced apart from, and generally coaxially surrounds, the inner casing 24. The turbine nozzle 22 further includes a row of circumferentially spaced apart turbine nozzle vanes. Only one turbine nozzle vane **28*a* is shown in FIG. 1A, and only two turbine nozzle vanes 28*a* and 28*b* are shown in FIG. 1B. First and second circumferentially adjacent turbine nozzle vanes 28*a* and 28*b* are each fixedly attached to at least one of the inner and outer casings 24 and 26. When the turbine nozzle 22 is disposed in the subassembly 10, the vanes 28*a* and 28*b* are disposed longitudinally adjacent and forward of the blades 20. The vanes 28*a* and 28*b* each have a generally airfoil shape with a leading edge 30, a suction side 32, a trailing edge 34, and a pressure side 36. The pressure side 36 of the first vane 28*a* is circumferentially spaced apart from the suction side 32 of the second vane 28*b* defining a vane airflow passage 38 bounded by the first and second vanes 28*a* and 28*b* and the inner and outer casings 24 and 26. The turbine nozzle 22 also includes means for varying the area of the vane airflow passage 38 proximate at least the pressure side 36 of the first vane 28*a***.

In a first preferred embodiment of the invention, as shown in FIGS. 1A and 1B, the area varying means includes a plug member 40 having a portion 42 insertable into and withdrawable from the vane airflow passage 38 through one of the inner and outer casings 24 and 26 proximate at least the pressure side 36 of the first vane **28*a*. The area varying means further includes means for inserting the portion 42 into and withdrawing the portion 42 from the vane airflow passage 38**.

Preferably, such inserting and withdrawing means includes the outer casing 26 having a boss 44 surrounding and guiding the portion 42 of the plug member 40 for insertion and withdrawal, the plug member 40 having internal screw threads 46 opposite the portion 42, the internal screw threads 46 engaging the external screw threads 48 of a bolt 50 protruding from the boss 44, the bolt 50 having an upper non-circular section 52 surrounded by the hinged angled socket end 54 of a link 56, the socket end 54 rotatably held against the boss 44 by a nut 58 engaging a threaded top section 60 of the bolt 50, and the link 56 having a pivotable connection 62 for rotation by a unison ring 64. The unison ring 64 is connected to actuate portions of other plug members for corresponding other vanes (not shown). The unison ring 64 is operated hydraulically, pneumatically, and/or electrically, etc. when a smaller turbine nozzle area is required for efficient engine operation during off-design conditions, as can be appreciated by those skilled in the art. Rotation of the unison ring 64 in one direction will insert the portion 42 of the plug member 40 into the vane airflow passage 38 while counterrotation of the unison ring 64 will withdraw the portion 42 from the vane airflow passage 38, such rotation and counterrotation serving to vary the area of the turbine nozzle 22. Other inserting and withdrawing means include axially Roving unison rings and those means known for mechanical clearance control in jet engines (i.e., mechanically moving circumferentially surrounding shroud segments radially towards and away from a row of rotor blade tips to maintain a constant clearance despite different rates of thermal expansion and contraction) and the like, as is known to those skilled in the art. In a particular application the plug member may be insertable into and withdrawable from the vane airflow passage through the inner casing, and, in another application, a first plug member may be associated with the outer casing and a second plug member may be associated with the inner casing.

In an exemplary design, as seen in FIG. 1B, the inserted portion 42 extends generally between the pressure side 36 of the first vane **28*a* and the suction side 32 of the second vane 28*b*. With all turbine nozzle vanes so equipped, this design blocks the entire end wall (the outer casing 26) of the vane airflow passage 38 to minimize losses and increase engine performance, as can be appreciated by those skilled in the art. Means are provided for generally sealing the inserted portion 42 and the pressure side 36 of the first vane 28*a* against leakage therebetween and for generally sealing the inserted portion 42 and the suction side 32 of the second vane 28*b* against leakage therebetween. Preferably, the sealing means includes the portion 42 having hooks 66 and the pressure side 36 of the first vane 28*a* and the suction side 32 of the second vane 28*b* having corresponding slots 68 for engaging the hooks 66 when the portion 42 is inserted into the vane airflow passage 38. Other sealing means include the hooks 66 being straight (like a leaf seal), labyrinth seals attached to the vanes 28*a* and 28*b* and/or portion 42**, and the like, as is known to those skilled in the art.

In the exemplary design seen in FIG. 1A, the outer casing 26 has a region 70 having a generally constant slope towards the longitudinal axis 12 as one moves longitudinally aft 16 of the trailing edge 34 of the first vane **28*a*. The portion 42 of the plug member 40 has a longitudinally forward edge 72 and a longitudinally aft edge 74 each generally aligned with the slope of region 70. The inserting and withdrawing means inserts and withdraws the portion 42 proximately along the region 70. It is seen that the closest distance of the outer casing 26 from the longitudinal axis 12 aft of the trailing edge 34 of the first vane 28*a* and forward of the blades 20 is generally equal to the closest distance of the inserted portion 42 from the axis 12. It is noted that the blades have cut-back leading edges 76 allowing for closer longitudinal placement of the vanes 28***a* and 28*b* to the blades 20.

In operation, propulsive gas flow 78*a* coming from the direction of the combustor (not shown), will see a reduced area turbine nozzle 22 during engine off-design operation to maximize the performance of the axial turbine 18 with minimum leakage of such flow 78*a* between the portion 42 and the pressure side 36 of the first vane 28*a* and between the portion 42 and the suction side 32 of the second vane 28*b*. The propulsive gas flow 78*b* exits the blades 20 in the direction of the exhaust nozzle (not shown).

Figure 2B:
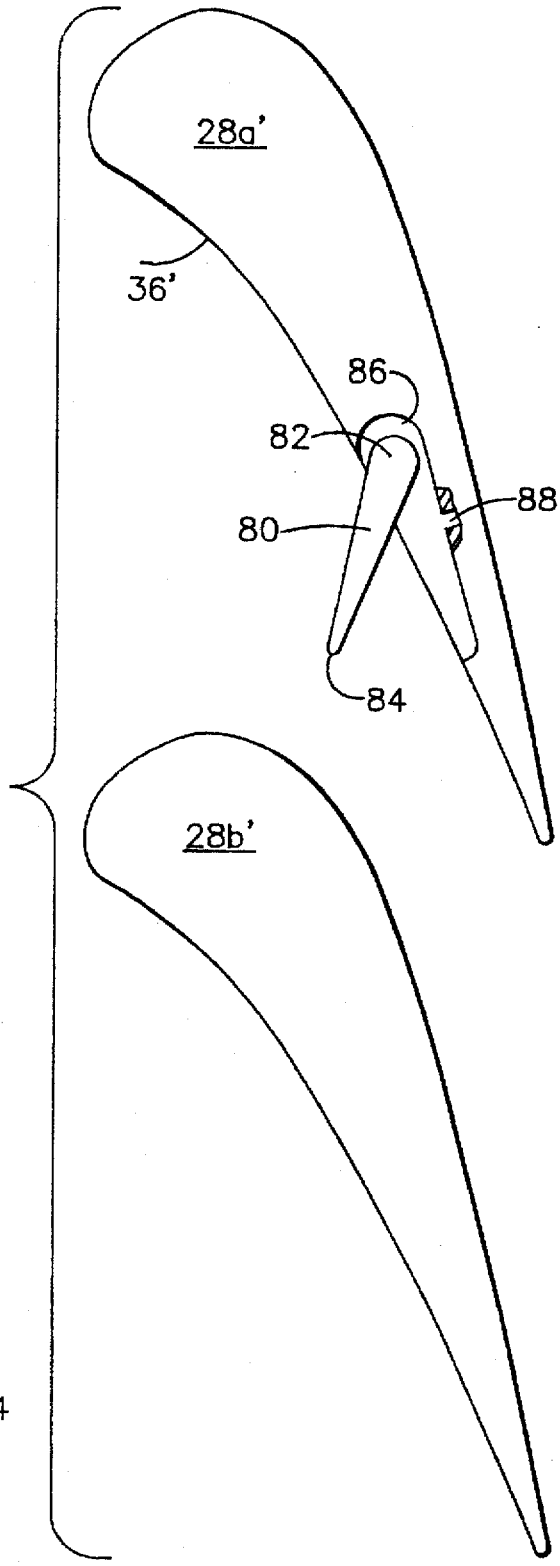
FIG. 2B is a schematic cross-sectional top view of a portion of FIG. 2A taken along lines 2B—2B.
Figure 2A:
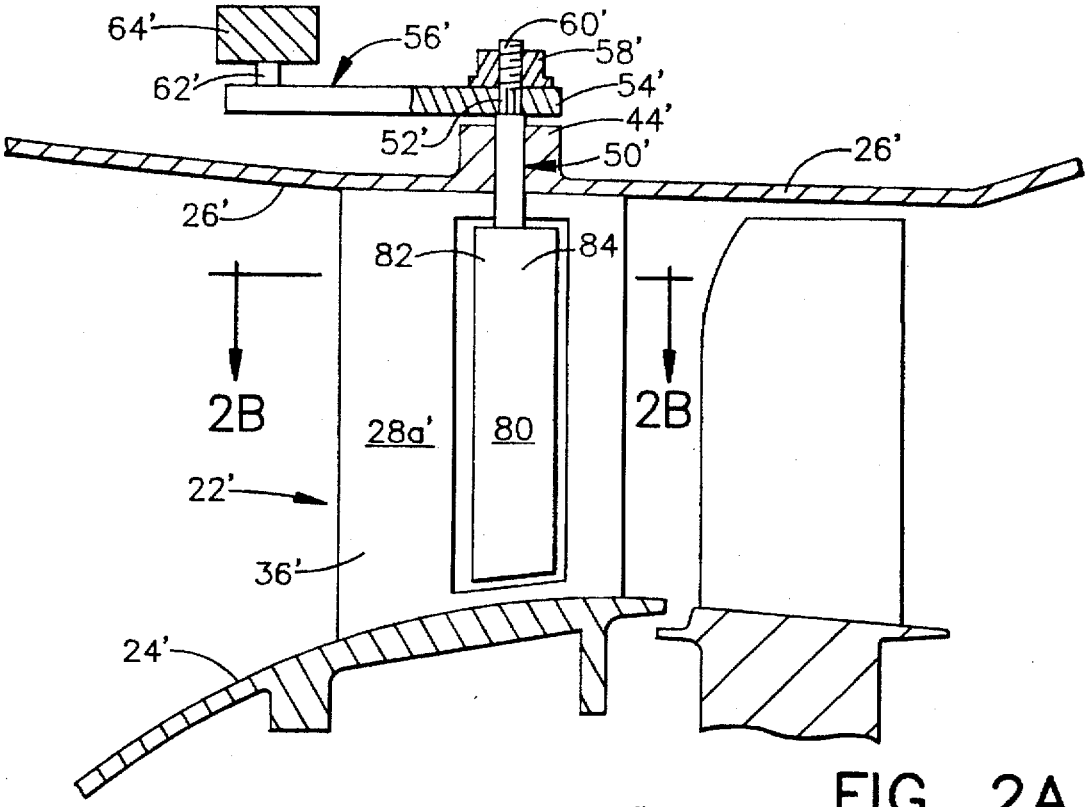
FIG. 2A is a schematic cross-sectional side view of a portion of a gas turbine engine including a turbine nozzle whose area is varied by a pivotable flap which can be pivoted away from and towards the pressure side of a vane.

In a second preferred embodiment of the invention, as shown in FIGS. 2A and 2B, the area varying means includes a pivotable flap 80 having a first end 82 and a second end 84. The first end 82 is pivotally attached to at least one of the inner and outer casings 24' and 26' and is disposed proximate the pressure side 36' of one vane 28*a'* of the row of circumferentially spaced apart turbine nozzle vanes. The second end 84 of the pivotable flap 80 is a free end. The area varying means further includes means for pivoting the flap 80 away from and towards the pressure side 36' of the one vane 28*a'* to vary the area of the turbine nozzle 22'.

Preferably, such pivoting means includes the pivotable flap 80 having a bolt 50' attached to the first end 82 of the pivotable flap 80, the bolt 50' extending to protrude from a boss 44' on the outer casing 26', the bolt 50' having an upper non-circular section 52' surrounded by the socket end 54' of a link 56', the socket end 54' rotatably held against the boss 44', by a nut 58', engaging a threaded top section 60' of the bolt 50', and the link 56' having a pivotable connection 62' for rotation by a unison ring 64'. Rotation of the unison ring 64' in one direction will pivot the flap 80 away from the pressure side 36' of the one vane 28*a'* while counterrotation of the unison ring 64' will pivot the flap 80 towards the one vane 28*a'*, such rotation and counterrotation serving to vary the area of the turbine nozzle 22'. Other pivoting means include those known for pivoting variable stator vanes of compressors in jet engines and the like, as is known to those skilled in the art.

In the exemplary design seen in FIG. 2B, the pressure side 36' of the one vane 28*a'* has a recess 86, the first end 82 of the pivotable flap 80 is at least partially disposed in the recess 86, and the second end 84 of the pivotable flap 80 is at least partially disposable in the recess 86. Preferably, the first end 82 is generally entirely disposed in the recess 86, and the second end 84 is generally entirely disposed in the recess 86 when the flap 80 is pivoted towards the pressure side 36' of the one vane 28*a'*. Such recess minimizes performance losses through the turbine nozzle 22' when the flap 80 is pivoted into the recess 86, as can be appreciated by those skilled in the art. The recess 86 also includes one or more cooling holes 88 which are uncovered when the flap 80 is pivoted away from the pressure side 36' of the one vane 28*a'*.

Figure 3A:
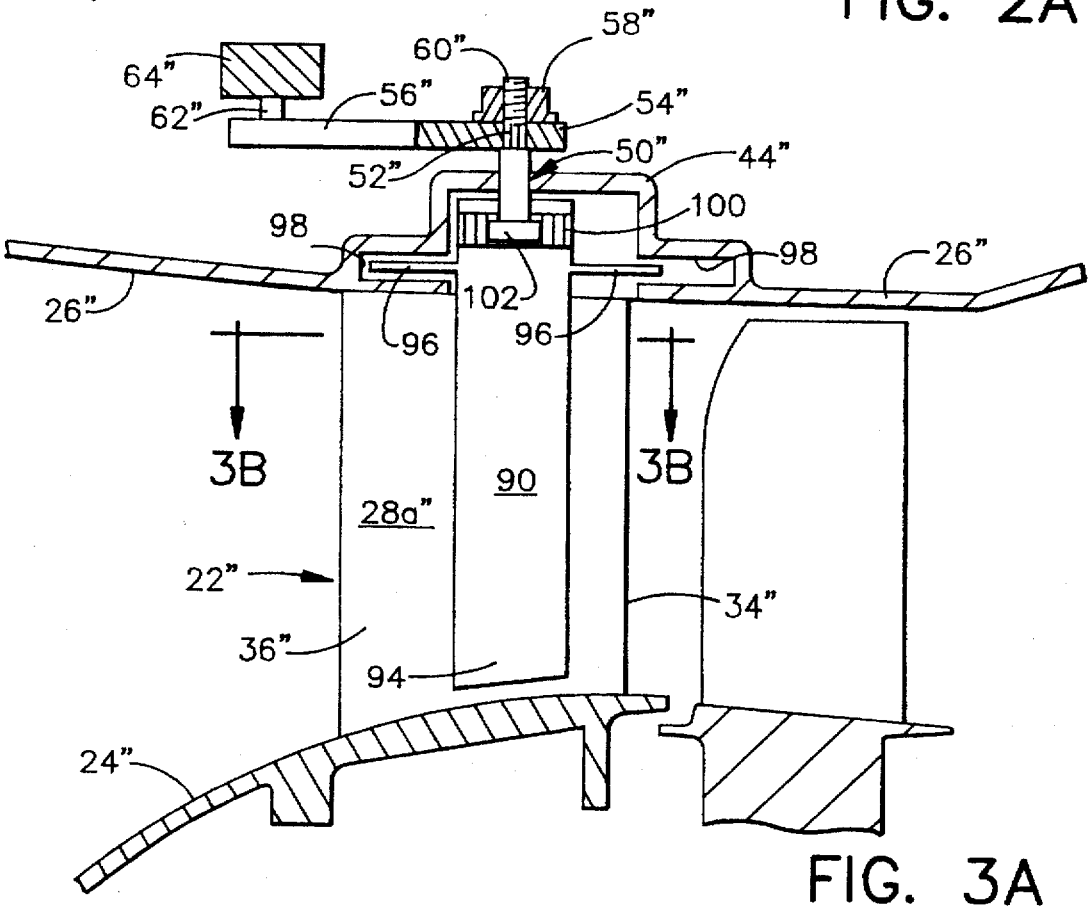
FIG. 3A is a schematic cross-sectional side view of a portion of a gas turbine engine including a turbine nozzle whose area is varied by a movable flap which can be moved proximately along the pressure side of one vane proximate the trailing edge of the vane.
Figure 3B:
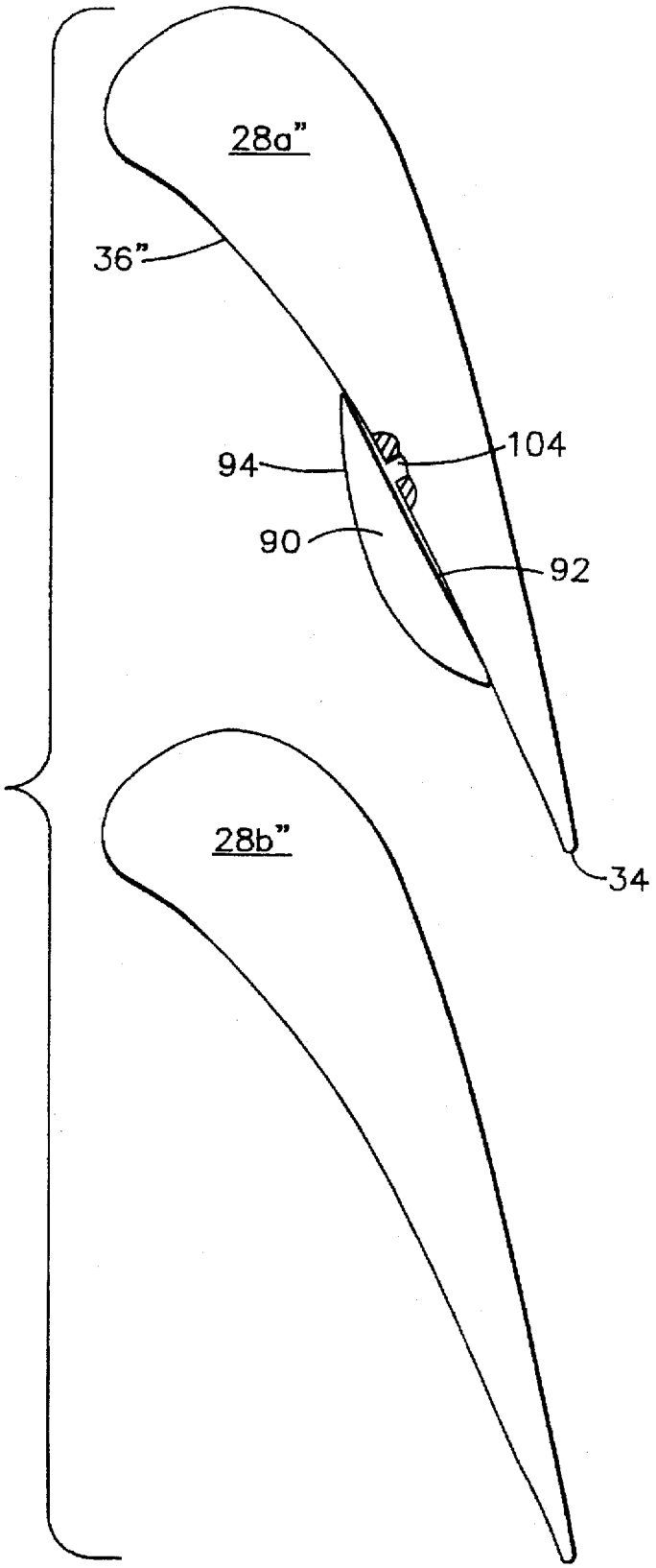
FIG. 3B is a schematic cross-sectional top view of a portion of FIG. 3A taken along lines 3B—3B.

In a third preferred embodiment of the invention, as shown in FIGS. 3A and 3B, the area varying means includes a movable flap 90 having a first side 92 and a generally opposing second side 94. The first side 92 of the movable flap 90 is disposed proximate the pressure side 36" of one vane 28*a"* of the row of circumferentially spaced apart turbine nozzle vanes. The movable flap 90 is attached to at least one of the inner and outer casings 24" and 26" with the first side 92 movable proximately along the pressure side 36"of the one vane 28*a"* proximate the trailing edge 34" of the one vane 28*a"*. The first side 92 of the movable flap 90 may or may not make slidable contact with the pressure side 36" of the one vane 28*a"*. The area varying means further includes means for moving the flap 90 proximately along the pressure side 36" of the one vane 28*a"* proximate the trailing edge 34" of the one vane 28*a"* to vary the area of the turbine nozzle 22".

Preferably, such moving means includes the movable flap 90 having generally longitudinally extending flanges 96 generally longitudinally slidable in corresponding grooves 98 of the outer casing 26", the movable flap 90 also having an upper portion contained within a boss 44" of the outer casing 26" and including a generally longitudinally extending toothed rack 100, the rack 100 engaged by a pinon wheel 102 attached to a bolt 50" extending to protrude from the boss 44", the bolt 50" having an upper non-circular section 52" surrounded by the socket end 54" of a link 56", the socket end 54" rotatably held against the boss 44", by a nut 58" engaging a threaded top section 60" of the bolt 50", and the link 56" having a pivotable connection 62" for rotation by a unison ring 64". Rotation of the unison ring 64" in one direction will move the flap 90 towards the trailing edge 34" of the one vane 28*a"* while counterrotation of the unison ring 64" will move the flap 90 away from the trailing edge 34" of the one vane 28*a"*, such rotation and counterrotation serving to vary the area of the turbine nozzle 22". Other moving means include those known for extending and retracting wing flaps on airplanes and the like, as is known to those skilled in the art.

In the exemplary design seen in FIG. 3B, the pressure side 36" of the one vane 28*a"* also includes one or more cooling holes 104 which are uncovered when the flap 90 is moved proximately along the pressure side 36" of the one vane 28*a"* towards the trailing edge 34" of the one vane 28*a"*. Preferably, the second side 94 of the movable flap 90 has a generally convex shape to achieve greater turbine nozzle area reduction with less flap movement.

The foregoing description of several preferred embodiments of the invention has been presented for purposes of illustration. It is not intended to be exhaustive or to limit the invention to the precise form disclosed, and obviously many modifications and variations are possible in light of the above teachings all of which are within the scope of the claims appended hereto.

We claim:

1. In a gas turbine engine subassembly having an axial turbine including a longitudinally forward-most row of rotor blades, a turbine nozzle comprising:

(a) a generally annular inner casing extending generally longitudinally forward and aft;

(b) a generally annular outer casing spaced apart from and generally coaxially surrounding said inner casing;

(c) first and second circumferentially adjacent turbine nozzle vanes each fixedly attached to at least one of said inner and outer casings, said vanes disposable longitudinally adjacent and forward of said blades, said vanes each having a generally airfoil shape with a leading edge, a suction side, a trailing edge, and a pressure side, and said pressure side of said first vane circumferentially spaced apart from said suction side of said second vane defining a vane airflow passage bounded by said vanes and said inner and outer casings;

(d) a plug member having a portion insertable into and withdrawable from said vane airflow passage through one of said inner and outer casings proximate at least said pressure side of said first vane; and (e) means for inserting said portion into and withdrawing said portion from said vane airflow passage, and wherein an inserted said portion extends generally entirely between said pressure side of said first vane and said suction side of said second vane.

2. The turbine nozzle of claim 1, also including means for generally sealing said inserted portion and said pressure side of said first vane against leakage therebetween and for generally sealing said inserted portion and said suction side of said second vane against leakage therebetween.

3. The turbine nozzle of claim 2, wherein said sealing means includes said portion having hooks and said pressure side of said first vane and said suction side of said second vane having corresponding slots for engaging said hooks when said portion is inserted into said vane airflow passage.

4. In a gas turbine engine subassembly having an axial turbine including a longitudinally forward-most row of rotor blades, a turbine nozzle comprising:

(a) a generally annular inner casing extending generally longitudinally forward and aft;

(b) a generally annular outer casing spaced apart from and generally coaxially surrounding said inner casing;

(c) first and second circumferentially adjacent turbine nozzle vanes each fixedly attached to at least one of said inner and outer casings, said vanes disposable longitudinally adjacent and forward of said blades, said vanes each having a generally airfoil shape with a leading edge, a suction side, a trailing edge, and a pressure side, and said pressure side of said first vane circumferentially spaced apart from said suction side of said second vane defining a vane airflow passage bounded by said vanes and said inner and outer casings;

(d) a plug member having a portion insertable into and withdrawable from said vane airflow passage through one of said inner and outer casings proximate at least said pressure side of said first vane; and (e) means for inserting said portion into and withdrawing said portion from said vane airflow passage, and also including a generally longitudinally extending axis, wherein said outer casing has a region having a generally constant slope towards said axis as one moves longitudinally aft of said trailing edge of said first vane, wherein said portion of said plug member has a longitudinally forward edge and a longitudinally aft edge each generally aligned with said slope, and wherein said inserting and withdrawing means inserts and withdraws said portion of said plug member proximately along said region.

5. The turbine nozzle of claim 4 wherein the closest distance of said outer casing from said axis aft of said trailing edge of said first vane and forward of said blades is generally equal to the closest distance of an inserted said portion from said axis.

6. The turbine nozzle of claim 4, wherein said blades have cut-back blade tip leading edges.

* * * * *